US006321054B1

(12) United States Patent
Park

(10) Patent No.: US 6,321,054 B1
(45) Date of Patent: Nov. 20, 2001

(54) METHOD AND APPARATUS FOR CLEANING LIQUID ELECTROPHOTOGRAPHIC PRINTER SQUEEGEE ROLLERS

(75) Inventor: Woo-yong Park, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/450,731

(22) Filed: Nov. 30, 1999

(30) Foreign Application Priority Data

Jan. 18, 1999 (KR) ..... 99-1256

(51) Int. Cl.[7] ..... G03G 15/10
(52) U.S. Cl. ..... 399/249
(58) Field of Search ..... 399/249

(56) References Cited

U.S. PATENT DOCUMENTS 5,937,250 * 8/1999 Kwak et al. ..... 399/249
6,094,553 * 7/2000 Shima ..... 399/249 X

* cited by examiner

*Primary Examiner*—William J. Royer
(74) *Attorney, Agent, or Firm*—Sughrue, Mion, Zinn, Macpeak & Seas, PLLC

(57) ABSTRACT

A squeegee roller cleaning apparatus of a liquid electrophotographic printer includes a squeegee roller and a cleaning roller. The squeegee roller is mounted to be operative for movement in order to selectively contact a photoreceptor web circulating along an endless path. The cleaning roller includes at least one blade member that is spirally twisted on the outer circumference of a rotary rod so as to contact the squeegee roller by the movement of the squeegee roller to remove a hold-up volume of developer. Thus, contamination of the photoreceptor web and the transfer roller can be reduced so that the quality of the printed image can be improved.

14 Claims, 7 Drawing Sheets

METHOD AND APPARATUS FOR CLEANING LIQUID ELECTROPHOTOGRAPHIC PRINTER SQUEEGEE ROLLERS

BACKGROUND OF THE INVENTION

1. Field of the Invention

The present invention relates to a squeegee roller cleaning apparatus of a liquid electrophotographic printer and, more particularly, to a squeegee roller cleaning apparatus of a liquid electrophotographic printer having an improved structure so that hold-up volume developer remaining at a portion where a blade and squeegee roller contact each other is removed after a drip-line removal mode.

2. Description of the Related Art

In a typical liquid electrophotographic printer, as shown in FIG. 1, a photoreceptor web 10 that is a photoreceptor medium is supported by a plurality of guide rollers 11 to circulate along an endless path. The surface of the photoreceptor web 10 is charged by a charger 12 to the electric potential of about 600 V. The surface of the photoreceptor web 10 charged as above is converted to a predetermined electric potential (about 250V) by light emitted from a plurality of laser scanning units 13 so that an electrostatic latent image is formed thereon. A plurality of development units 20 for developing the electrostatic latent image with developer is installed to form a predetermined gap (hereinafter, referred to as a development gap) between the photoreceptor web 10 and each development unit 20. The development unit 20 also includes a development roller 22 maintaining an electric potential of about 450V. Charged developer is injected into the development gap by an injector (not shown). As the electric potential of the developer is lower than that of the development roller 22, the developer is transferred to an area where the electrostatic image is formed and adheres thereto.

The developer adhering to the electrostatic latent image area due to the difference in electric potential is squeezed by a squeegee roller 24 so that toner in the developer becomes filmy and is converted to a toner image. The remainder of the developer, other than the filmy toner, is removed by being squeezed from the photoreceptor web 10. Here, the toner image is dried by a drying unit 15. Also, the toner image is transferred from the photoreceptor web 10 to a transfer roller 16 due to the difference in surface energy between the transfer roller 16 and the photoreceptor web 10. The toner image on the surface of the transfer roller 16 is printed on the surface of a print paper P passing between the transfer roller 16 and a fixation roller 17.

After the development mode, as shown in FIG. 2, the development roller 22 is lowered to remove the developer, or drip-line developer D, remaining on the photoreceptor web 10 between the development roller 22 and the squeegee roller 24. Then, the squeegee roller 24, while being in contact with the photoreceptor web 10, is rotated opposite the direction in which the photoreceptor web 10 travels. As a result, the drip-line developer D is removed from the photoreceptor web 10 and the removed drip-line developer flows along the outer circumference of the squeegee roller 24 and is removed by a squeegee blade 26 contacting the surface of the squeegee roller 24.

However, after the drip-line removal mode, as shown in FIG. 3, the developer at a portion where the squeegee roller 24 and the blade 26 contact each other is not clearly removed so that a small amount of remaining developer referred to as hold-up volume developer B remains unnecessarily.

The blade 26 linearly contacts the squeegee roller 24 in a lengthwise direction. Thus, as shown in FIG. 4, the hold-up volume developer B remains on the surfaces of the blade 26 and the squeegee roller 24 even when the blade 26 is separated from the squeegee roller 24. The leftover developer remaining on the surface of the squeegee roller 24 is hardened thereon and transferred to the photoreceptor web 10 at the next development mode to contaminate the photoreceptor web 10 as well as the transfer roller 16 of FIG. 1.

SUMMARY OF THE INVENTION

To solve the above problems, it is an objective of the present invention to provide a squeegee roller cleaning apparatus of a liquid electrophotographic printer which removes a small amount of developer, referred to herein as the hold-up volume developer, remaining on the surface of the squeegee roller after a drip-line removal mode so that the photoreceptor web and transfer roller can be prevented from being contaminated.

Accordingly, to achieve the above objective, there is provided a squeegee roller cleaning apparatus of a liquid electrophotographic printer, which comprises a squeegee roller mounted to be operative for movement in order to selectively contact a photoreceptor web circulating along an endless path, and a cleaning roller including at least one blade member which is spirally twisted on an outer circumference of a rotary rod so as to contact the squeegee roller by the movement of the squeegee roller.

It is preferred in the present invention that the cleaning roller comprises a coupling groove formed in the outer circumferential surface of the rotary rod so that a root portion of the blade member can be inserted.

Also, it is preferred in the present invention that the blade member is formed of a rubber material to be elastically twisted.

It is preferred in the present invention to provide a squeegee blade capable of movement to longitudinally contact the squeegee roller.

It is a further objective of the present invention to provide a method of removing a hold-up volume of developer from a squeegee roller situated in a liquid electrophotographic printer, wherein the liquid electrophotographic printer includes a photoreceptor web circulating along an endless path, a movable squeegee roller that selectively contacts the photoreceptor web, a cleaning roller that includes at least one blade member spirally twisted on an outer circumference of a rotary rod so as to contact the squeegee roller, and a movable squeegee blade that selectively contacts the squeegee roller.

Accordingly, to achieve the above objective, there is provided a method to remove the hold-up developer volume by displacing the squeegee roller from the photoreceptor web; contacting the squeegee roller with a squeegee blade and rotating the squeegee roller against the squeegee blade, halting the rotation of the squeegee roller and displacing the squeegee blade from the squeegee roller, thereby leaving a hold-up volume of developer remaining on the squeegee roller; displacing the squeegee roller, whereby at least one blade member of the cleaning roller contacts the squeegee roller; and rotating the squeegee roller so that at least one blade member removes the hold-up volume of developer remaining on the squeegee roller.

It is preferred that the squeegee roller is rotated in a direction opposite to the direction of travel of the photoreceptor web when the squeegee roller is rotated against the squeegee blade.

Also, it is preferred that the squeegee roller is rotated in a direction opposite to the rotational direction of the cleaning roller when the at least one blade member is in contact with the squeegee roller.

BRIEF DESCRIPTION OF THE DRAWINGS

The above objective and advantages of the present invention will become more apparent by describing in detail a preferred embodiment thereof with reference to the accompanying drawings in which.

DETAILED DESCRIPTION OF THE INVENTION

Figure 1:
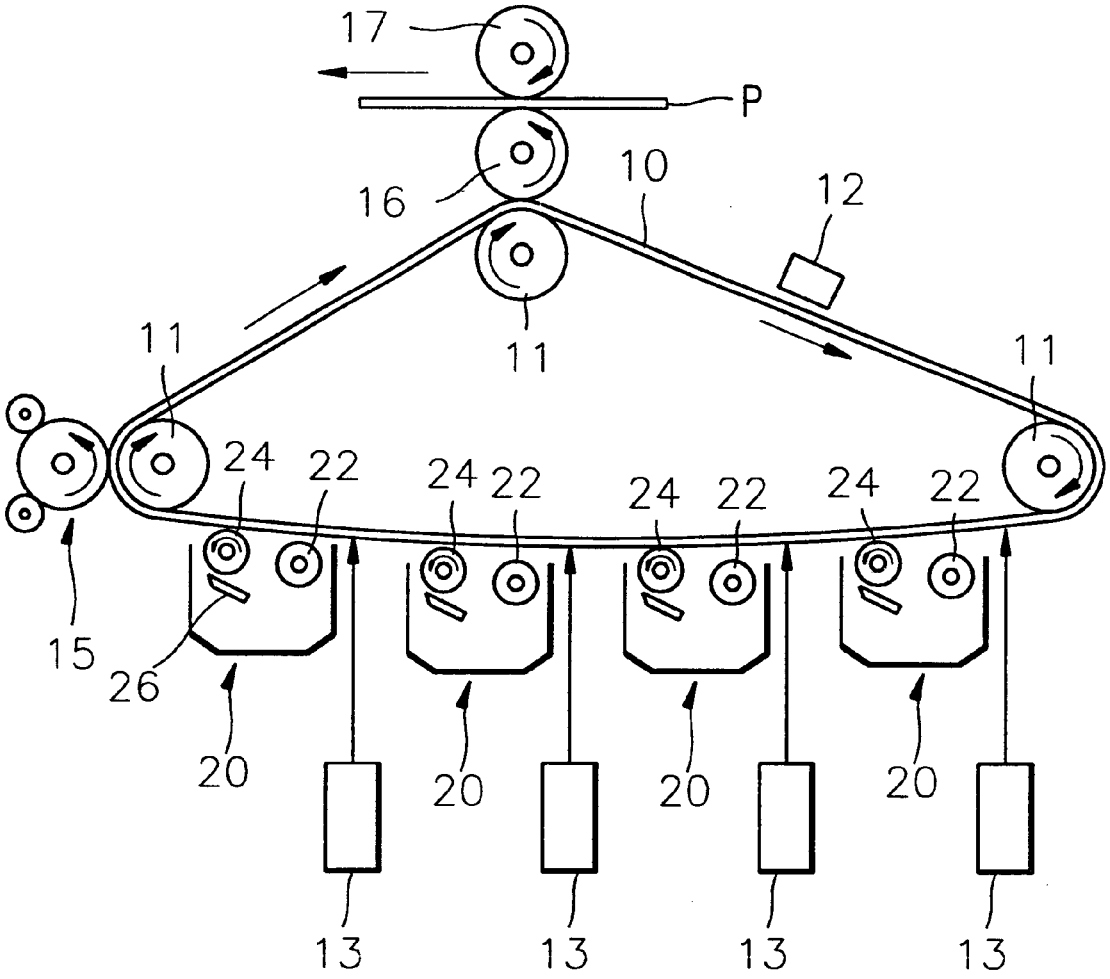
FIG. 1 (PRIOR ART)
FIG. 1 is a view showing the structure of a typical liquid electrophotographic printer.
Figure 2:
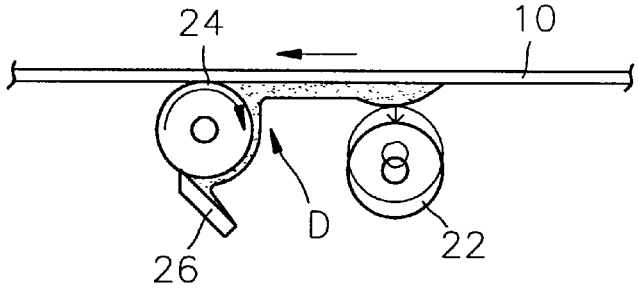
FIG. 2 (PRIOR ART)
FIGS. 2 through 4 are views showing the formation of drip-line developer D and hold-up volume developer B in the liquid electrophotographic printer of FIG. 1.
Figure 3:
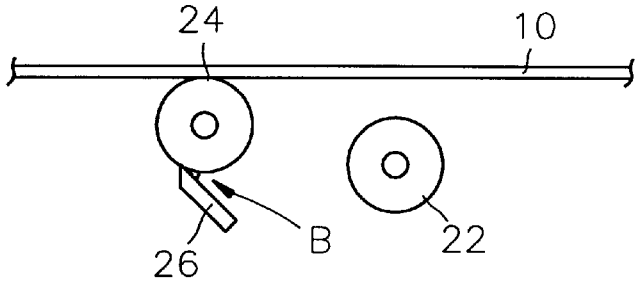
FIG. 3 (PRIOR ART)
Figure 4:
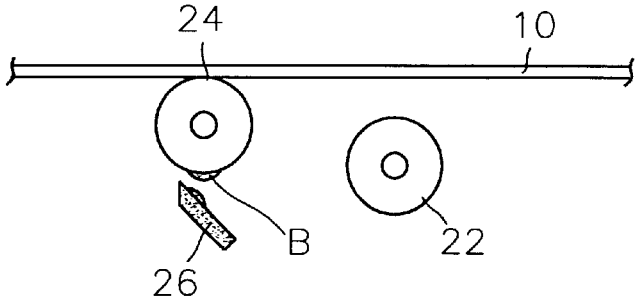
FIG. 4 (PRIOR ART)
Figure 5:
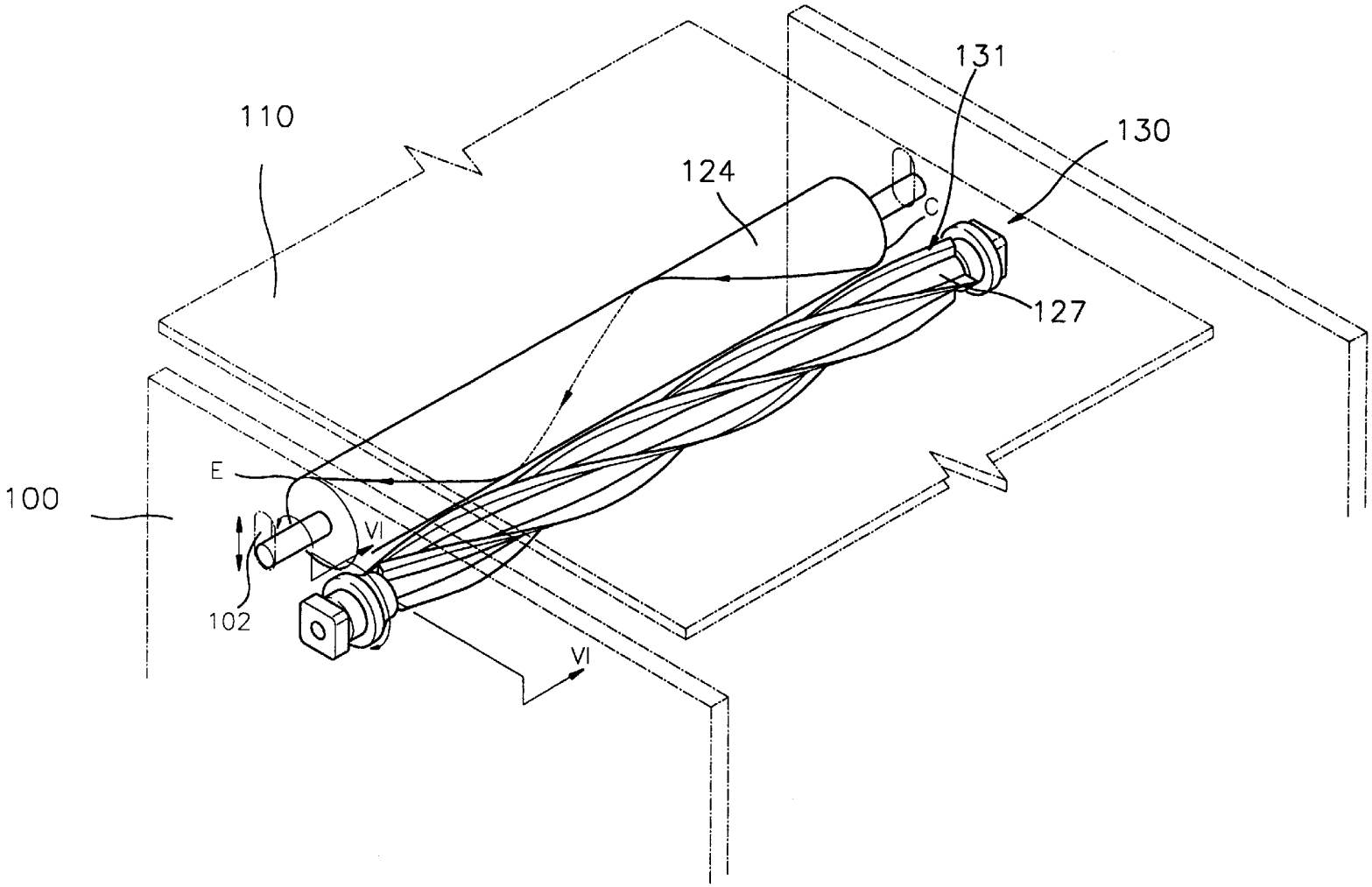
FIG. 5 is a perspective view showing a squeegee roller cleaning apparatus of a liquid electrophotographic printer according to a preferred embodiment of the present invention.
Figure 6:
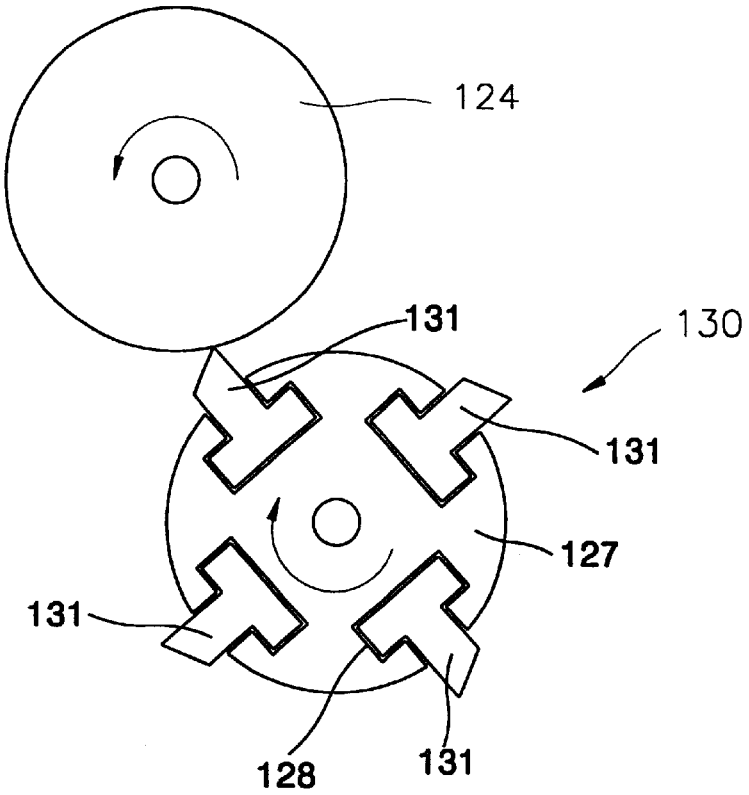
FIG. 6 is a sectional view taken along line VI—VI of FIG. 5.

Referring to FIGS. 5 and 6, a squeegee roller cleaning apparatus of a liquid electrophotographic printer according to a preferred embodiment of the present invention includes a squeegee roller 124 installed at a main body 100 of a development apparatus to be capable of moving up and down to selectively contact the photoreceptor web 110 which is a photoreceptor medium circulating, and a cleaning roller 130, installed at the main body 100 of the development apparatus to be capable of contacting the squeegee roller 124 as the squeegee roller 124 descends, for removing a hold-up volume of developer remaining on the surface of the squeegee roller 124. The cleaning roller 130 includes a rotary rod 127 rotated by a driving device (not shown) opposite the direction in which the squeegee roller 124 rotates.

The rotary rod 127 is provided with blade members 131 which are installed elastically and spirally twisted along the lengthwise direction of the rotary rod 127. That is, a coupling groove 128 corresponding to a root portion of each of the blade members 131 is spirally formed in the outer circumference of the rotary rod 127. Each root portion of blade members 131 is inserted in the coupling groove 128. Alternatively, the root portions of blade members 131 can be directly and spirally attached to the outer circumference of the rotary rod 127, unlike the above. Although four blade members 131 are installed at the outer circumference of the rotary rod 127 in the present embodiment, the number of blade members 131 is not limited thereto.

Figure 7A:
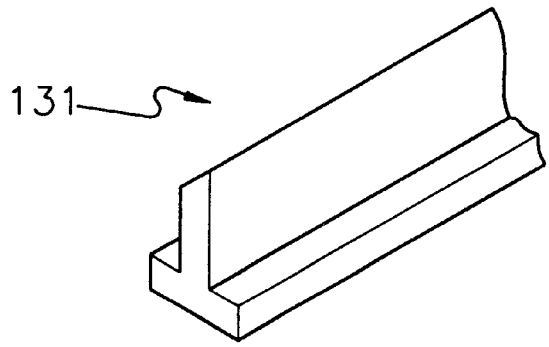
FIGS. 7A through 7F are perspective views showing the various shapes of the blade member shown in FIG. 5.
Figure 7B:
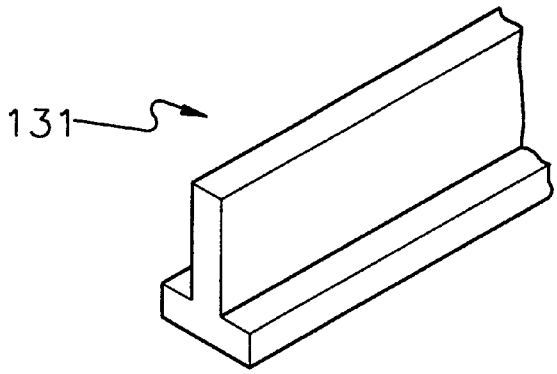
Figure 7C:
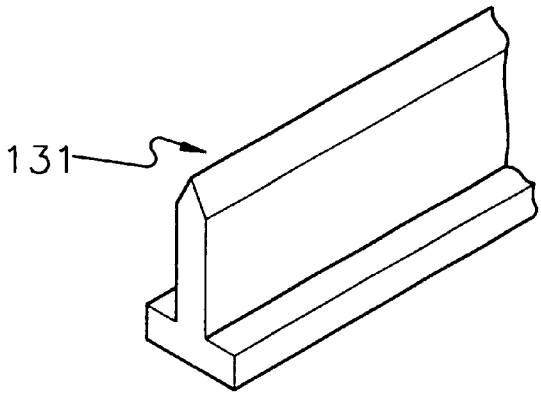
Figure 7D:
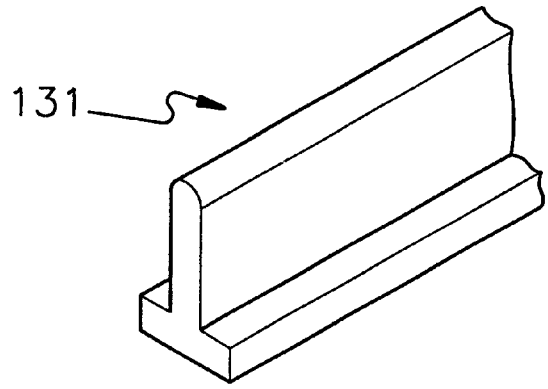
Figure 7E:
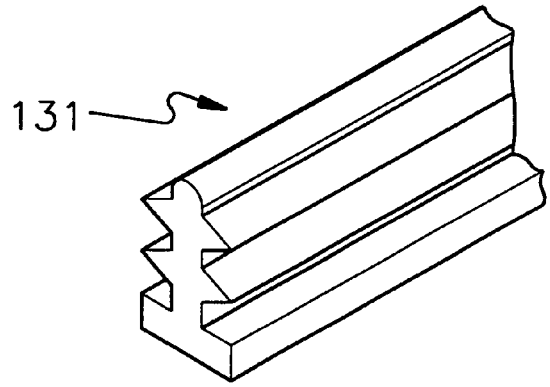
Figure 7F:
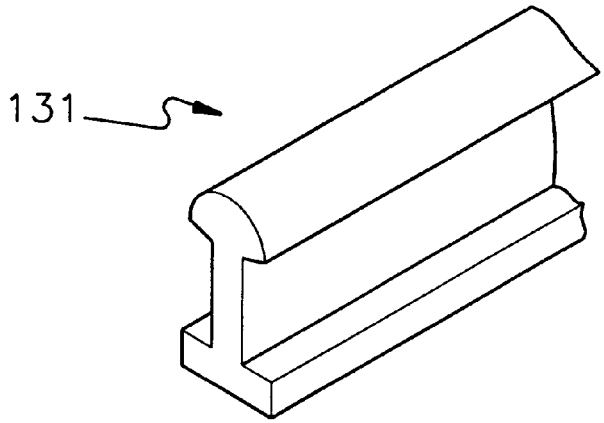

As shown in FIGS. 7A through 7F, the shape of the end portion of blade members 131 can be formed to be linearly inclined to one side (FIG. 7A), square (FIG. 7B), wedge-like (FIG. 7C), or round (FIG. 7D). Also, at least one protrusion is extended laterally from each side of the root portion as shown in FIG. 7E and the shape of the end portion of blade members 131 can be formed to be fan-shaped as shown in FIG. 7F. Here, the blade members 131 are preferably formed of a rubber material thereby allowing the blade members 131 to be elastically twisted.

Figure 8:
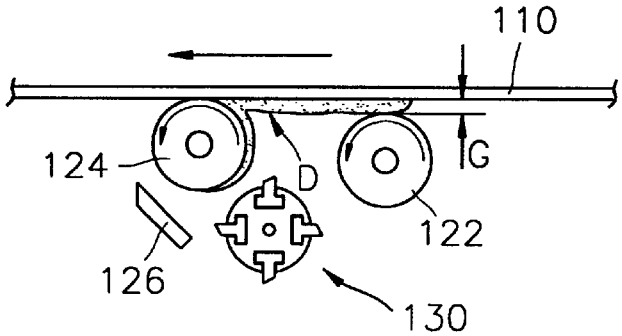
FIGS. 8 through 11 are views for explaining the operation of removing the hold-up volume developer remaining on the surface of the squeegee roller by the cleaning apparatus shown in FIG. 5.

In the operation of the squeegee roller cleaning apparatus of a liquid electrophotographic printer having the above structure according to a preferred embodiment of the present invention, referring to FIG. 8, during a development mode, the development roller 122 ascends toward the photoreceptor web 110 such that the development gap G between the photoreceptor web 110 and the development roller 122 can be maintained. Next, an injection device (not shown) injects developer into the development gap G. The development roller 122 develops the developer adhering to the electrostatic latent image area due to a difference in electric potential between the development roller 122 and the electrostatic latent image area.

Also, the developer adhering to the electrostatic latent image area of the photoreceptor web 110 is squeezed by being pressed by the squeegee roller 124 so that toner of the developer becomes filmy and the remaining developer falls downward. Here, the squeegee roller 124 is rotated by the photoreceptor web 110 in the same direction of travel of the photoreceptor web 110. At this time, a squeegee blade 126 remains separated a predetermined distance from the photoreceptor web 110 without contacting the outer circumference of the squeegee roller 124. This is to prevent damage to an image formed on the electrostatic latent image of the photoreceptor web 110 caused by reduction of rotational speed of the squeegee roller 124 as the squeegee roller 124 contacts the squeegee blade 126.

After the development mode is terminated, a developer drip-line D is generated as the developer still remains at the area where the photoreceptor web 110 and the squeegee roller 124 contact each other. That is, a portion of the developer squeezed by the squeegee roller 124 which has not fallen downward remains at an area where the squeegee roller 124 and the photoreceptor web 110 contact each other. The drip-line developer should be removed periodically to continuously maintain a clear quality image in the next developed image.

Figure 9:
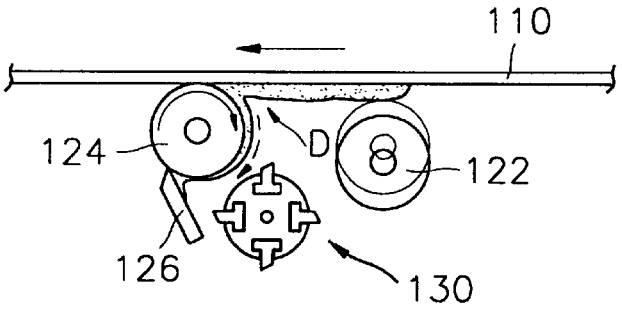

Referring to FIG. 9, in a drip-line removal mode after the termination of the development mode, the development roller 122 descends under the photoreceptor web 110 to reduce rotational load according to a pressing force between the photoreceptor web 110 and the development roller 122, and the rotational direction of the squeegee roller 124 is reversed. While the squeegee blade 126 continuously contacts the surface of the squeegee roller 124, as the squeegee roller 124 is rotated in the reverse direction as above, the developer remaining at the one side of the squeegee roller 124 flows along the outer circumference of the squeegee roller 124 as indicated by a dotted line. Then, the developer is abraded by the squeegee blade 126 so as not to further roll along the outer circumference of the squeegee roller 124.

Figure 10:
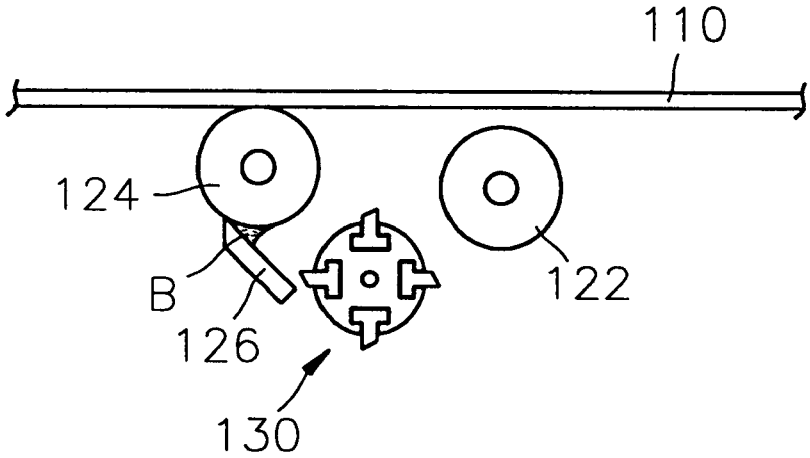

Referring to FIG. 10, after the drip-line removal mode is terminated, the developer at the area where the squeegee roller 124 and the squeegee blade 126 contact each other is not completely removed so that hold-up volume developer B remains unnecessarily. The hold-up volume developer B still remains on the surface of the squeegee roller 124 after the squeegee blade 126 is separated from the surface of the squeegee roller 124.

Figure 11:
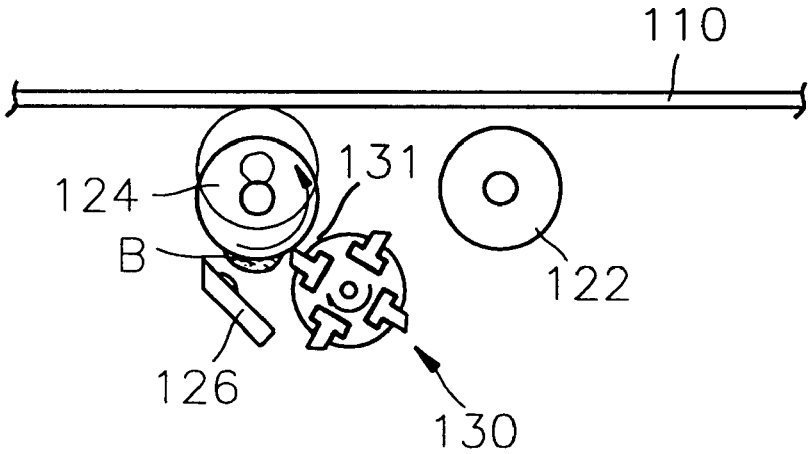

Referring to FIG. 11, in a hold-up volume removal mode, as the squeegee blade 126 is separated a predetermined distance from the surface of the squeegee roller 124, the squeegee roller 124, driven by an elevation device (not shown), is lowered toward the cleaning roller 130 and is guided by guide groove 102 (see FIG. 5) formed on the main body 100 (see FIG. 5) of the development apparatus. As it is being lowered, the squeegee roller 124 contacts one of the blade members 131 of the cleaning roller 130. Then, the squeegee roller 124 is rotated in the reverse direction to the rotation direction in the drip-line removal mode and the cleaning roller 130 is rotated in the reverse direction to the rotation direction of the squeegee roller 124. A plurality of blade members 131 installed in a spiral shape remove the hold-up volume developer B adhering to the surface of the squeegee roller 124 by abrading and collecting the hold-up volume developer B along the outer circumferential surface of the squeegee roller 124 in the lengthwise direction.

Referring to FIG. 5, the blade members 131 abrade and collect the hold-up volume developer B remaining at position C at the surface of the squeegee roller 124 in a direction indicated by an arrow. Consequently, the hold-up volume developer B is moved to position E along the surface of the squeegee roller 124 and falls downward.

The blade members 131 are spirally formed by being twisted on the outer circumference of the rotary rod 127 to prevent the developer adhering to the contact area from remaining on the surface of the squeegee roller 124 as the squeegee roller 124 is separated from the cleaning roller 130 in the development mode. This is to minimize the contact area between the blade members 131 and the squeegee roller 124 by allowing blades of the blade members 131 to partially contact the squeegee roller 124. That is, the blades of the blade members 131 partially contact the squeegee roller 124 during the rotation of the rotary rod 127. Thus, the contact area moves from the position C to the position E and the hold-up volume developer B adhering to the surface of the squeegee roller 124 moves together with the movement of the contact area of the blade members 131 so that the hold-up volume developer B at the position E of the squeegee roller 124 falls downward.

Although the hold-up volume developer B remains finely at the surface of the squeegee roller 124 while the hold-up volume developer B is cleaned, as the contact areas of the blade members 131 are continuously moved toward the position E, the hold-up volume developer B can be completely removed.

Thereafter, the squeegee roller 124 ascends concurrently when the printer is converted to a development mode and is separated a predetermined distance from the cleaning roller 130. Thus, the hold-up volume removal mode is terminated.

As described above, in the squeegee roller cleaning apparatus of a liquid electrophotographic printer according to the present invention, as the hold-up volume developer remaining on the surface of the squeegee roller is removed by the cleaning roller provided with spiral blade members after the drip-line removal mode is terminated, contamination of the photoreceptor web and the transfer roller can be drastically reduced contrary to the conventional technology. As a result, the quality of the printed image can be improved.

It is noted that the present invention is not limited to the preferred embodiment described above, and it is apparent that variations and modifications by those skilled in the art can be effected within the spirit and scope of the present invention defined in the appended claims.

What is claimed is:

1. A squeegee roller cleaning apparatus of a liquid electrophotographic printer, comprising:

a squeegee roller mounted to be operative for movement in order to selectively contact a photoreceptor web circulating along an endless path; and a cleaning roller including at least one blade member which is spirally twisted on an outer circumference of a rotary rod so as to contact said squeegee roller by the movement of said squeegee roller.

2. The apparatus as claimed in claim 1, wherein said cleaning roller comprises at least one coupling groove formed in the outer circumferential surface of said rotary rod so that a root portion of said at least one blade member can be inserted.

3. The apparatus as claimed in claim 2, wherein said at least one coupling groove comprises a plurality of coupling grooves.

4. The apparatus as claimed in claim 3, wherein said at least one blade member comprises a plurality of blade members.

5. The apparatus as claimed in claim 2, wherein said at least one coupling groove comprises two to four coupling grooves.

6. The apparatus as claimed in claim 5, wherein said at least one blade member comprises two to four blade members.

7. The apparatus as claimed in claim 2, wherein said at least one coupling groove conforms to said root portion of said at least one blade member, thereby retaining said at least one blade member in said at least one coupling groove.

8. The apparatus as claimed in claim 1, wherein said at least one blade member is formed of a rubber material to be elastically twisted.

9. The apparatus as claimed in claim 1, wherein said at least one blade member comprises a plurality of blade members.

10. The apparatus as claimed in claim 1, wherein said at least one blade member comprises two to four blade members.

11. The apparatus as claimed in claim 1, further comprising a squeegee blade capable of movement to longitudinally contact said squeegee roller.

12. A method of removing a hold-up volume of developer from a squeegee roller of a liquid electrophotographic printer, wherein said liquid electrophotographic printer includes a photoreceptor web circulating along an endless path, a movable squeegee roller that selectively contacts said photoreceptor web, a cleaning roller that includes at least one blade member spirally twisted on the outer circumference of a rotary rod so as to contact said squeegee roller, and a movable squeegee blade that selectively contacts said squeegee roller, the method comprising:

displacing said squeegee roller from said photoreceptor web;

contacting said squeegee roller with said squeegee blade and rotating said squeegee roller against said squeegee blade;

halting the rotation of said squeegee roller and displacing said squeegee blade from said squeegee roller, thereby leaving a hold-up volume of developer remaining on said squeegee roller;

displacing said squeegee roller, whereby said at least one blade member of said cleaning roller contacts said squeegee roller; and rotating said squeegee roller so that said at least one blade member removes the hold-up volume of developer remaining on said squeegee roller.

13. The method as claimed in claim 12, wherein the step of rotating said squeegee roller against said squeegee blade further includes rotating said squeegee roller in a direction opposite to the direction of travel of the photoreceptor web.

14. The method as claimed in claim 12, wherein the step of rotating said squeegee roller against said at least one blade member further includes rotating said cleaning roller in a rotational direction opposite to the rotational direction of said squeegee roller.

* * * * *